US009831602B1

(12) United States Patent
Kanda et al.

(10) Patent No.: US 9,831,602 B1
(45) Date of Patent: Nov. 28, 2017

(54) CONNECTOR

(71) Applicant: Yazaki Corporation, Tokyo (JP)

(72) Inventors: Hidenori Kanda, Makinohara (JP); Hiromasa Kubota, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/596,193

(22) Filed: May 16, 2017

(30) Foreign Application Priority Data

May 30, 2016 (JP) ..... 2016-107422

(51) Int. Cl.
*H01R 13/629* (2006.01)

(52) U.S. Cl.
CPC ..... *H01R 13/62977* (2013.01)

(58) Field of Classification Search
CPC ..... H01R 13/62933; H01R 13/6295; H01R 13/62977
USPC ..... 439/157
See application file for complete search history.

(56) References Cited

U.S. PATENT DOCUMENTS

2007/0032107 A1* 2/2007 Matsubara ..... H01R 13/62955 439/157
2014/0235081 A1* 8/2014 Shimizu ..... H01R 13/62933 439/157
2015/0162698 A1* 6/2015 Hara ..... H01R 13/518 439/157
2016/0226187 A1* 8/2016 Sakamoto ..... H01R 13/64

FOREIGN PATENT DOCUMENTS

JP 9-259971 A 10/1997

* cited by examiner

*Primary Examiner* — Briggitte R Hammond
(74) *Attorney, Agent, or Firm* — Sughrue Mion, PLLC

(57) ABSTRACT

A connector includes a lever attachable to a first housing to draw and fit the first housing and a second housing by rotating around a rotating axis from a temporary lock position to a final lock position. The lever includes: a positioning portion including a pair of wall surfaces which extend toward the first housing and which are spaced at a predetermined distance from each other in a first direction parallel to the rotating axis; and a lever side lock portion. The first housing includes: a reception portion which receives the positioning portion so as to hold the pair of wall surfaces in the first direction; and a housing-side lock portion to which the lever-side lock portion is locked in a state in which the positioning portion has been received in the reception portion and when the lever is in the final lock position.

3 Claims, 7 Drawing Sheets

CONNECTOR

CROSS-REFERENCE TO RELATED APPLICATION(S)

This application is based on and claims priority from Japanese Patent Application (Application No. 2016-107422) filed on May 30, 2016, the entire contents of which are incorporated herein by reference.

BACKGROUND

1. Field of the Invention

One or more embodiments of the present invention relate to a connector including a first housing, a second housing fittable to the first housing, and a lever attachable to the first housing to draw and fit the first housing and the second housing to each other by moving from a temporary lock position to a final lock position around a rotating axis.

2. Description of Related Art

A lever type connector having a lever for assisting housings of the connector to be fitted to each other has been proposed in the background art.

For example, in one of such background-art lever type connectors (hereinafter referred to as "background-art connector"), a lever is rotatably attached to one of housings, and a lock protrusion is provided in the housing so that a lock piece provided in the lever can be locked to the lock protrusion. The lock piece is locked to the lock protrusion as soon as the lever is rotated to a predetermined position (final lock position). Thus, the lever can be retained in the position (final lock position) (for example, see JP-A-9-259971).

SUMMARY

The lever of the background-art connector may be deformed when an excessive external force acts on the lever from a different direction from a rotating direction thereof. In an example of such deformation of the lever, the position of the lock piece may be displaced to another position than a position (proper position) corresponding to the lock protrusion (for example, due to misalignment occurring between the lock piece and the lock protrusion, center lines of the lock piece and the lock protrusion may disagree with each other). In a case where such deformation occurs, it is likely that the lock piece cannot be locked to the lock protrusion normally even if the lever is rotated to the predetermined position (final lock position).

When the deformation (misalignment) occurs in the lever, some measures are required at the fitting time. For example, the lever has to be returned to the proper position by manual operation of a worker (the deformation has to be corrected, and the lock piece and the lock protrusion have to be aligned with each other). Therefore, such deformation (misalignment) can be dealt with by the worker or the like in a fitting step, but can cause deterioration in workability in the fitting step.

One or more embodiments of the present invention have been developed in consideration of the above-described situation, and an object thereof is to provide a connector capable of easily positioning a lever and a housing with each other.

<1> A connector including: a first housing; a second housing fittable to the first housing; and a lever attachable to the first housing to draw and fit the first housing and the second housing to each other by rotating around a rotating axis from a temporary lock position to a final lock position, wherein the lever includes: a positioning portion including a pair of wall surfaces which extend toward the first housing and which are spaced at a predetermined distance from each other in a first direction parallel to the rotating axis; and a lever side lock portion, and wherein the first housing includes: a reception portion which receives the positioning portion so as to hold the pair of wall surfaces in the first direction; and a housing-side lock portion to which the lever-side lock portion is locked in a state in which the positioning portion has been received in the reception portion and when the lever is in the final lock position.

<2> The connector according to the aspect <1>, wherein the positioning portion is not received in the reception portion when the lever is in the temporary lock position, and wherein the positioning portion begins to be received in the reception portion when the lever is being rotated from the temporary lock position to the final lock position.

<3> The connector according to the aspect <1> or <2>, wherein the positioning portion includes a base structure including: a pair of side plates forming the pair of wall surfaces; and a bottom plate connecting protruding ends of the pair of side plates with each other, and wherein the lever-side lock portion has a cantilever-like arm structure extending from the bottom plate.

According to the connector having the aspect <1>, when the lever is rotated, the positioning portion provided in the lever is received into the reception portion provided in the first housing, so as to be held therein. In the state where the positioning portion has been received in the reception portion, the lever-side lock portion is locked to the housing-side lock portion. Thus, even when some misalignment occurs in the lever, the misalignment is corrected naturally in accordance with rotation of the lever, so that the lever-side lock portion and the housing-side lock portion can be positioned with each other.

Accordingly, in the connector having the configuration, the lever and the housing can be easily positioned with each other.

Further, the connector having the configuration also has an effect of making it possible for a worker or the like to easily recognize excessive misalignment. Specifically, when the lever is rotated from the temporary lock position toward the final lock position in a case where excessive misalignment occurs between the lever and the first housing, the alignment portion abuts against the reception portion before the lever reaches the final lock position (that is, when the lever is being rotated), so that the lever cannot be rotated more. On this occasion, the rotating angle of the lever from the temporary lock position is smaller than a proper rotating angle (a rotating angle at which the lever can reach the final lock position), so that the positioning portion cannot be perfectly received in the reception portion. Therefore, the worker can easily recognize that the lever does not reach the final lock position.

According to the connector having the aspect <2>, the positioning portion is not received in the reception portion when the lever is in the temporary lock position. The positioning portion begins to be received in the reception portion when the lever is being rotated from the temporary lock position to the final lock position. To say other words, there is a distance between the reception portion and the positioning portion when the lever is in the temporary lock position, and the reception portion and the positioning portion begin to abut against each other when the lever is being rotated. Accordingly, the size of the positioning portion and the size of the reception portion (and hence the size of the connector) can be reduced as compared with a case where the positioning portion is received at the time when the lever is in the temporary lock position (for example, a case where the reception portion extends to the lever located in the temporary lock position or a case where the positioning portion extends to the reception portion from the lever located in the temporary lock position). Thus, in the connector having the configuration, it is possible to easily position the lever and the housing with each other while avoiding increase in size of the connector.

According to the connector having the aspect <3>, when the cantilever-like arm structure is applied to a locking structure of the lever, the base structure supporting the arm structure (the fixed end of the cantilever) can be also used as a structure for positioning the lever and the housing with each other. Accordingly, the structure of the connector can be simplified as compared with a case where the base structure and the positioning structure are provided separately from each other. Thus, in the connector having the configuration, it is possible to easily position the lever and the housing with each other while avoiding increase in size of the connector.

According to one or more embodiments of the invention, it is possible to provide a connector capable of easily positioning a lever and a housing with each other.

One or more embodiments of invention have been described briefly above. The further details of the invention will be made clearer if the following embodiments described in the detailed description are read through with reference to the accompanying drawings.

DETAILED DESCRIPTION

Embodiment

A connector according to an embodiment of the invention will be described below with reference to the drawings.

Figure 1:
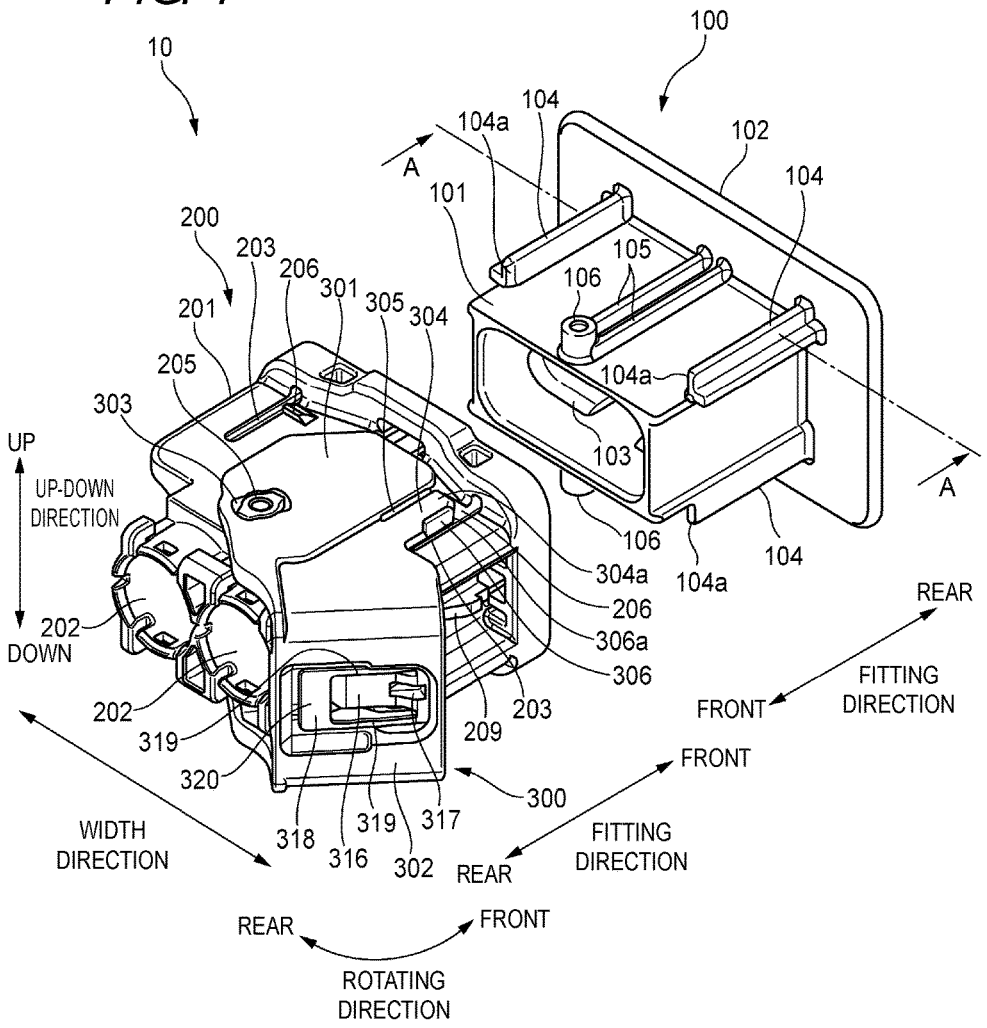
FIG. 1 is a perspective view of a connector according to an embodiment of the invention.

As shown in FIG. 1, a connector 10 according to the embodiment of the invention includes a male housing 100, a female housing 200, and a lever 300. The female housing 200 is fitted to the male housing 100 so that the female housing 200 can receive the male housing 100 (that is, the male housing 100 can be internally inserted into the female housing 200). The lever 300 is rotatably attached to the female housing 200. Incidentally, the connector 10 according to the embodiment is a connector for a board, in which the male housing 100 can be attached to an electronic circuit board or the like (not shown).

A "fitting direction", a "width direction", an "up/down direction", a "front side", a "rear side", an "upper side", a "lower side", and a "rotating direction" of the lever 300 will be defined below as shown in FIG. 1. The "fitting direction", the "width direction" and the "up/down direction" are perpendicular to one another. Further, a "time when the male housing 100 and the female housing 200 are fitted to each other" will be also referred to as "fitting time". FIG. 1 shows a state in which the lever 300 is in a temporary lock position. When the lever 300 is rotated forward in the rotating direction from the temporary lock position, the lever 300 moves toward a final lock position.

As shown in FIG. 1, the male housing 100 is made of resin and provided with a body peripheral wall portion 101 and a flange portion 102. The body peripheral wall portion 101 is formed into an angular cylindrical shape long in the width direction. The flange portion 102 has a rectangular shape extending in the up/down direction and the width direction integrally from a rear end portion of the body peripheral wall portion 101. Inside the body peripheral wall portion 101, a plurality of terminal reception chambers 103 are formed in the fitting direction. A plurality of male terminals (not shown) formed in the male housing 100 by insert molding are received in the terminal reception chambers 103 respectively (also see FIG. 12).

Temporary lock releasing ribs 104 are formed in the four corners of the body peripheral wall portion 101 respectively. The temporary lock releasing ribs 104 protrude outward in the up/down direction and extend forward in the fitting direction from the flange portion 102. Central ribs 105 and bosses 106 are formed in central portions of upper and lower surfaces of the body peripheral wall portion 101 respectively. The central ribs 105 protrude outward in the up/down direction and extend forward in the fitting direction from the flange portion 102. The bosses 106 are located in front end portions of the central ribs 105 and protrude outward in the up/down direction to be higher than the central ribs 105, respectively. The temporary lock releasing ribs 104 and the bosses 106 will be described in detail later.

Figure 2:
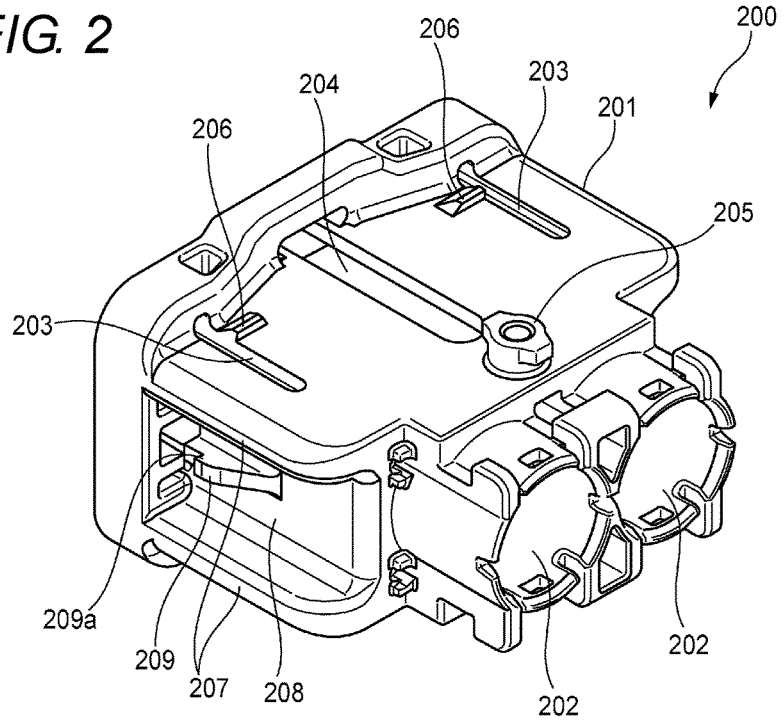
FIG. 2 is a perspective view in which a female housing is observed from its back side.

As shown in FIG. 1 and FIG. 2, the female housing 200 is made of resin, and provided with a body peripheral wall portion 201 having an angular cylindrical shape long in the width direction. The male housing 100 and the female housing 200 are fitted so that an inner circumferential surface of the body peripheral wall portion 201 and an outer circumferential surface of the body peripheral wall portion 101 of the male housing 100 can overlap each other at the fitting time. Inside the body peripheral wall portion 201, a plurality of terminal reception chambers 202 are formed in the fitting direction so that a plurality of female terminals (not shown) connected to end portions of electric wires (not shown) can be received in the terminal reception chambers 202 respectively.

Slits 203 are formed near opposite end portions of upper and lower surfaces of the body peripheral wall portions 201 in the up/down direction. The slits 203 penetrate the peripheral wall and extend rearward in the fitting direction from a front end portion of the body peripheral wall portion 201. A front end of each slit 203 is open forward in the fitting direction. Each slit 203 extends rearward up to the vicinity of a central portion of the body peripheral wall portion 201 in the fitting direction. Central slits 204 are formed in central portions of the upper and lower surfaces of the body peripheral wall portion 201 respectively. The central slits 204 penetrate the peripheral wall and extend rearward in the fitting direction from the front end portion of the body peripheral wall portion 201. A front end of each slit 204 is open forward in the fitting direction. Each slit 204 extends rearward up to the vicinity of the central portion of the body peripheral wall portion 201 in the fitting direction.

At the fitting time, the temporary lock releasing ribs 104 of the male housing 100 are inserted and guided into corresponding ones of the slits 203 respectively so that outside end portions of the temporary lock releasing ribs 104 in the up/down direction can protrude from the peripheral wall (that is, the temporary lock releasing ribs 104 can penetrate the peripheral wall), and the bosses 106 of the male housing 100 are inserted and guided into corresponding ones of the central slits 204 respectively so that outside end portions of the bosses 106 in the up/down direction can protrude from the peripheral wall (that is, the bosses 106 can penetrate the peripheral wall).

In the upper and lower surfaces of the body peripheral wall portion 201, rotating shafts 205 are formed in rear positions of the rear end portions of the central slits 204 respectively so as to protrude outward in the up/down direction. A pair of holes 303 of the lever 300 (connection portions between the lever 300 and the female housing 200) are fitted to the pair of rotating shafts 205. Thus, the lever 300 can be attached to the female housing 200 rotatably around the pair of rotating shafts 205.

In the upper and lower surfaces of the body peripheral wall portion 201, temporary lock protrusions 206 are formed adjacently to the inner sides of the slits 203 in the width direction respectively so as to protrude outward in the up/down direction. The temporary lock protrusions 206 are provided to lock the lever 300 in a temporary lock position (as will be described in detail later).

A pair of ribs 207 are formed in each of opposite side surfaces of the body peripheral wall portion 201 in the width direction. The ribs 207 protrude outward in the width direction from the upper and lower walls, and extend in the fitting direction and in parallel to each other. As a result, a recess portion 208 sinking inward in the width direction is formed between each pair of ribs 207. In a bottom surface of each recess portion 208, a lock beak 209 is formed to protrude outward in the width direction. A step portion 209*a* is formed in an outer end portion of each lock beak 209 in the width direction. The pairs of ribs 207 (the recess portions 208) and the lock beaks 209 are provided so that the lever 300 located in a final lock position can be retained in the final lock position (as will be described in detail later).

As shown in FIG. 1 and FIGS. 3 to 5, the lever 300 is made of resin and formed into an approximately U-shape, including a pair of side plate portions 301 and a connection portion 302 connecting one ends of the pair of side plate portions 301 with each other. A pair of holes 303 which are through holes are formed in the pair of side plate portions 301. The pair of rotating shafts 205 of the female housing 200 are inserted into the pair of holes 303 so that the lever 300 can be rotated relatively to the female housing 200 (around the pair of rotating shafts 205) in a state where the pair of side plate portions 301 have held the upper and lower surfaces of the female housing 200.

Cuts 305 (for example, see FIG. 5) such as slits are formed in front end portions of the pair of side plate portions 301 in the rotating direction respectively. As a result, in the front end portions of the pair of side plate portions 301 in the rotating direction, a pair of temporary lock arms 304 are formed adjacently to the pair of cuts 305. Each temporary lock arm 304 has a long and narrow cantilever-like shape having a fixed end in the vicinity of a deepest portion of a corresponding one of the cuts 305.

As shown in FIG. 1, in the state where the lever 300 is in the temporary lock position, front end portions 304*a* of the pair of temporary lock arms 304 are located in rotating positions to the front of female housing 200, and locked to the temporary lock protrusions 206 of the male housing 200. Since the temporary lock arms 304 are locked to the temporary lock protrusions 206, the lever 300 is locked in the temporary lock position while the lever 300 is inhibited from moving to the final lock position.

Figure 3:
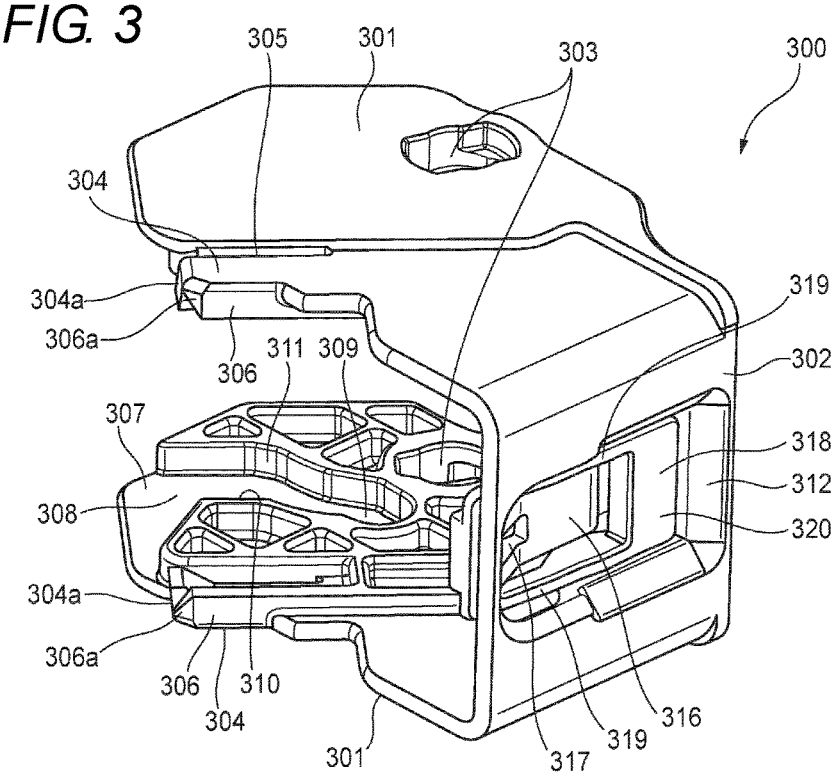
FIG. 3 is a perspective view in which a lever is observed from the outside (the outside of the lever if the lever is attached to the female housing).
Figure 4:
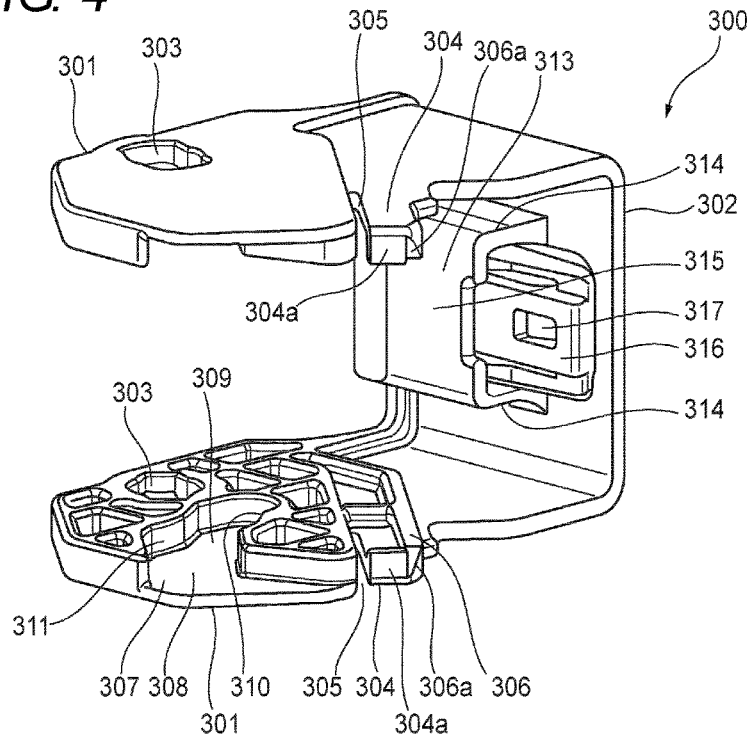
FIG. 4 is a perspective view in which the lever is observed from the inside (the inside of the lever if the lever is attached to the female housing).
Figure 5:
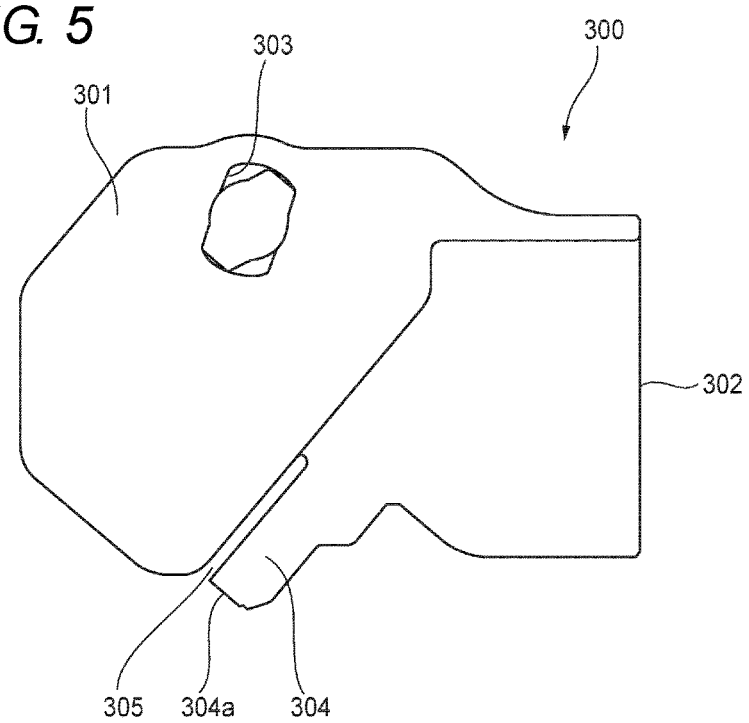
FIG. 5 is a side view of the lever.

In an inner side surface of each temporary lock arm 304 in the up/down direction, a reinforcing rib 306 extending in the extending direction of the temporary lock arm 304 is formed in an opposite side end surface to a corresponding one of the cuts 305 (for example, see FIG. 3 and FIG. 4). Due to the reinforcing ribs 306 formed thus, rigidity can be enhanced against outward deformation of the temporary lock arms 304 in the up/down direction (in a direction away from the surface of the female housing 200), as compared with a case where the reinforcing ribs 306 are absent. As a result, in the lever 300 located in the temporary lock position, the temporary lock arms 304 and the temporary lock protrusions 206 can be surely prevented from being unintentionally separated (released from the locking).

Tapered faces 306*a* are formed in front end portions of the reinforcing ribs 306 in the extending directions thereof respectively. At the fitting time, the tapered faces 306*a* of the pair of temporary lock arms 304 are pushed by front end surfaces 104*a* (see FIG. 1) of the corresponding temporary lock releasing ribs 104 of the male housing 100 so that the pair of temporary lock arms 304 can be elastically deformed outward in the up/down direction as shown by the arrows in FIG. 6. As a result, the locking of the temporary lock arms 304 by the temporary lock protrusions 206 is released so that the lever 300 can move forward in the rotating direction from the temporary lock position toward the final lock position.

Figure 6:
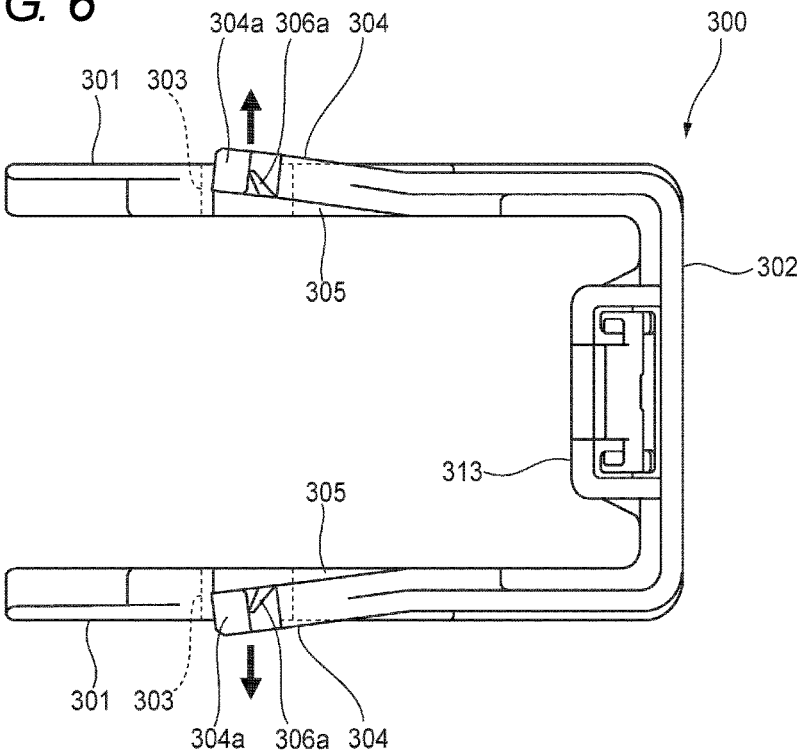
FIG. 6 is a view for explaining a state in which a temporary lock arm of the lever is deformed.

As shown in FIG. 6, due to the existence of the pair of cuts 305, the pair of temporary lock arms 304 are deformed preferentially when the temporary lock arms 304 are elastically deformed outward in the up/down direction. Thus, the side plate portions 301 as a whole (particularly around the pair of holes 303) are hardly elastically deformed outward in the up/down direction. Therefore, the pair of holes 303 are hardly detached from the pair of rotating shafts 205, as compared with a case where the cuts 305 are absent. As a result, the lever 300 and the female housing 200 can be prevented from being easily separated (that is, the lever 300 can be prevented from easily coming off).

Grooves 307 are formed in the inner side surfaces of the pair of side plate portions 301 in the up/down direction respectively (for example, see FIG. 3 and FIG. 4). The pair of grooves 307 are provided to draw the pair of bosses 106 of the male housing 100 from entrance portions 308 of the grooves 307 to deepest portions 309 thereof as the lever 300 is rotated from the temporary lock position to the final lock position (as will be described in detail later). Incidentally, each groove 307 is defined by a side wall 310 located forward in the rotating direction, and a side wall 311 located rearward in the rotating direction and continuously to the side wall 310.

A through hole 312 is formed in the connection portion 302 of the lever 300. A base portion 313 is formed integrally with the connection portion 302 so as to close a rear part of the through hole 312 in the rotating direction from the back side of the connection portion 302. The base portion 313 includes a pair of side plate portions 314 like flat plates, and a bottom plate portion 315 like a flat plate. The side plate portions 314 protrude on the back side from back side surfaces of the connection portion 302, and face each other at a predetermined interval in the up/down direction. The bottom plate portion 315 connects protruding end portions of the pair of side plate portions 314 with each other. When the lever 300 is attached to the female housing 200, outer side surfaces of the pair of side plate portions 314 in the up/down direction extend toward the female housing 200 and at a predetermined interval in a parallel direction to the pair of rotating shafts 205 of the female housing 200.

In a front side surface of the bottom plate portion 315, a cantilever-like lock arm 316 is formed integrally to extend forward in the rotating direction so as to have a fixed end on its rear side in the rotating direction. A lock hole 317 which is a through hole is formed in a front end portion of the lock arm 316. On the front surface side of the lock arm 316, a releasing arm 318 is formed integrally. The releasing arm 318 has a pair of arm portions 319, and an operating portion 320. The arm portions 319 extend rearward in the rotating direction, at an interval in the up/down direction and in parallel with each other from upper and lower positions of the lock hole 317 of the lock arm 316 respectively. The operating portion 320 connects front end portions of the pair of arm portions 319 with each other.

The base portion 313 and the lock arm 316 are provided so that the lever 300 located in the final lock position can be retained in the final lock position by the base portion 313 and the lock arm 316 in cooperation with a pair of the pairs of ribs 207 (one of the recess portions 208) and one of the lock beaks 209 of the female housing 200 (see FIG. 2).

Specifically, when the lever 300 is moved (rotated) from the temporary lock position toward the final lock position, the base portion 313 is received in the recess portion 208 so that the pair of side plate portions 314 can be held between the pair of ribs 207. When the lever 300 reaches the final lock position in the state where the base portion 313 has been received in the recess portion 208, the lock arm 316 abuts against the lock beak 209 and goes through elastic deformation on the front surface side of the lock arm 316. Thus, the lock hole 317 of the lock arm 316 is locked to the step portion 209*a* of the lock beak 209.

Since the lock hole 317 is locked to the step portion 209*a*, the lever 300 located in the final lock position can be retained in the final lock position. On the other hand, when the operating portion 320 of the releasing arm 318 is pushed toward the female housing 200 in this state, the lock arm 316 is elastically deformed on the front surface side to thereby release the locking of the lock hole 317 to the step portion 209*a*. As a result, the lever 300 can move from the final lock position toward the temporary lock position (rearward in the rotating direction).

An operation in which the lever 300 attached to the female housing 200 is rotated from the temporary lock position to the final lock position to thereby draw the male housing 100 from a fitting start state to a fitting completion state will be described below briefly with reference to FIGS. 7 to 12.

Figure 7:
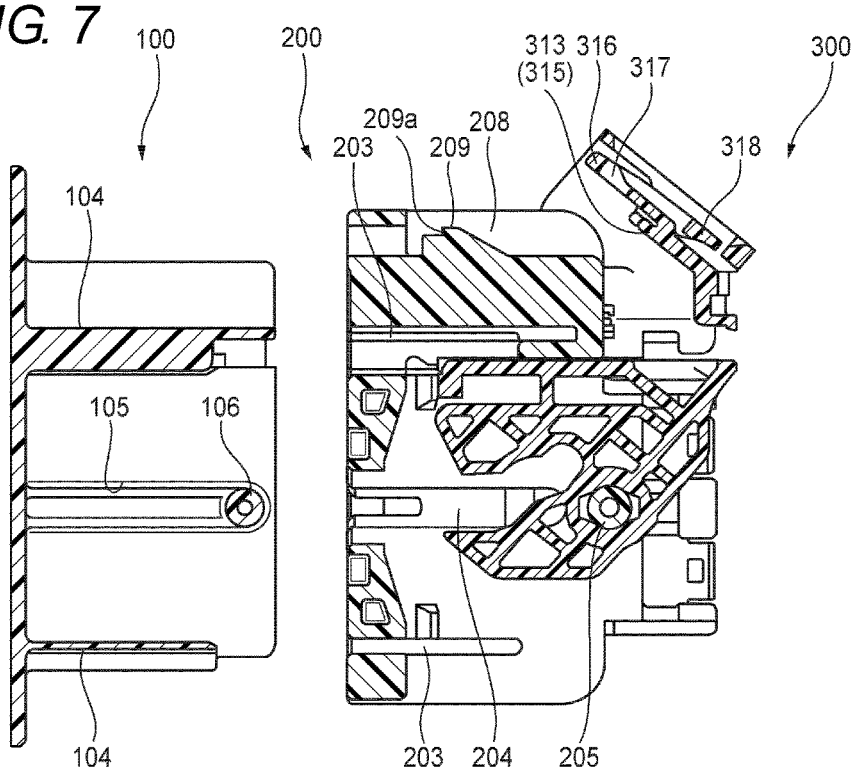
FIG. 7 is a sectional view showing a state in which a male housing and the female housing have not been fitted to each other yet.

First, the front surface of the female housing 200 in which the lever 300 has been locked in the temporary lock position and the front surface of the male housing 100 are disposed to face each other as shown in FIG. 7. As shown in FIG. 7, in the state where the lever 300 is in the temporary lock position, the base portion 313 has not been received in the recess portion 208 yet.

Figure 8:
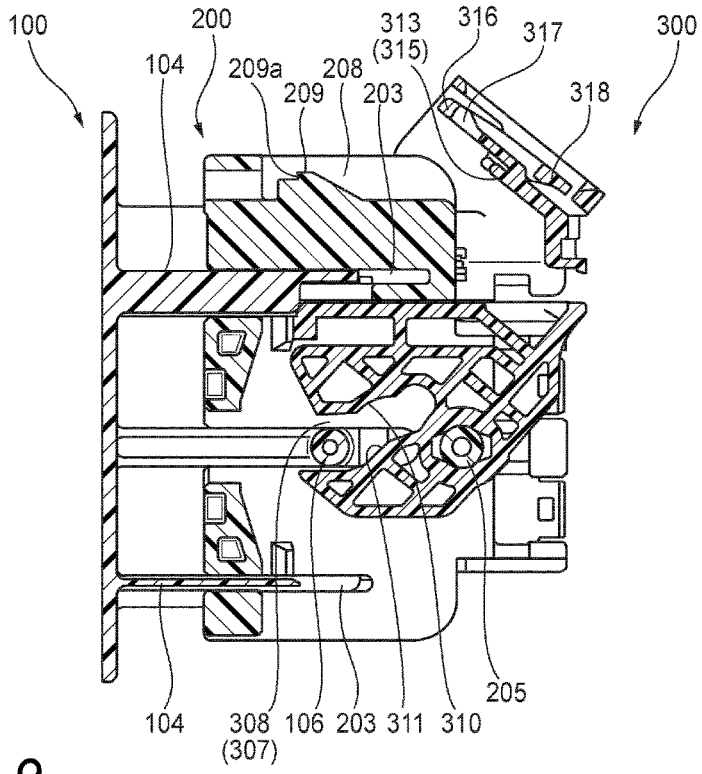
FIG. 8 is a sectional view taken on line A-A in FIG. 1, showing a state in which the male housing and the female housing begin to be fitted to each other.

Next, as shown in FIG. 8, the male housing 100 is inserted into the female housing 200 to reach a fitting start state. In the fitting start state, the tapered faces 306*a* (see FIGS. 3 and 4) of the pair of temporary lock arms 304 are pushed by the front end surfaces 104*a* (see FIG. 1) of the corresponding temporary lock releasing ribs 104 of the male housing 100 respectively, so that the pair of temporary lock arms 304 are elastically deformed outward in the up/down direction. Thus, the lever 300 can move from the temporary lock position to the final lock position. In the fitting start state, the pair of bosses 106 of the male housing 100 are located in the entrance portions 308 (see FIGS. 3 and 4) of the pair of grooves 307 of the lever 300.

Figure 9:
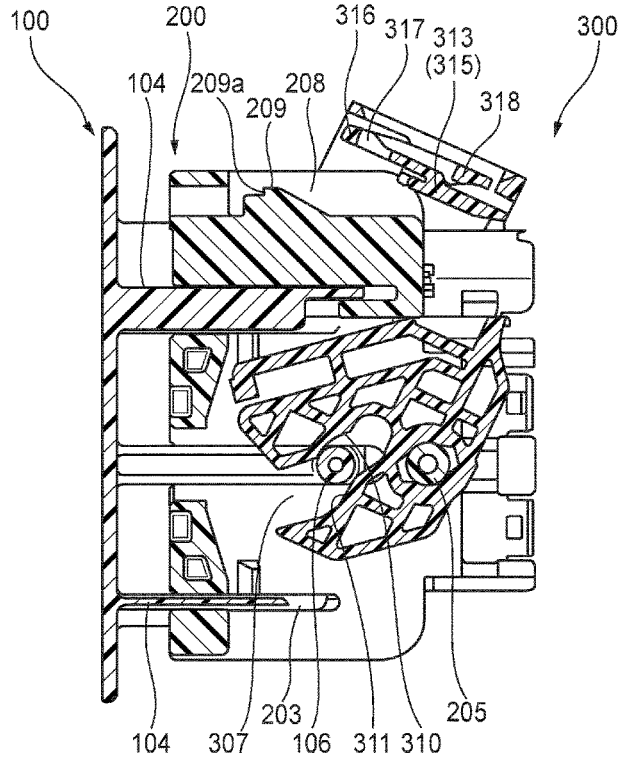
FIG. 9 is a sectional view taken on line A-A in FIG. 1, showing a state in which the male housing and the female housing are being fitted to each other.
Figure 11:
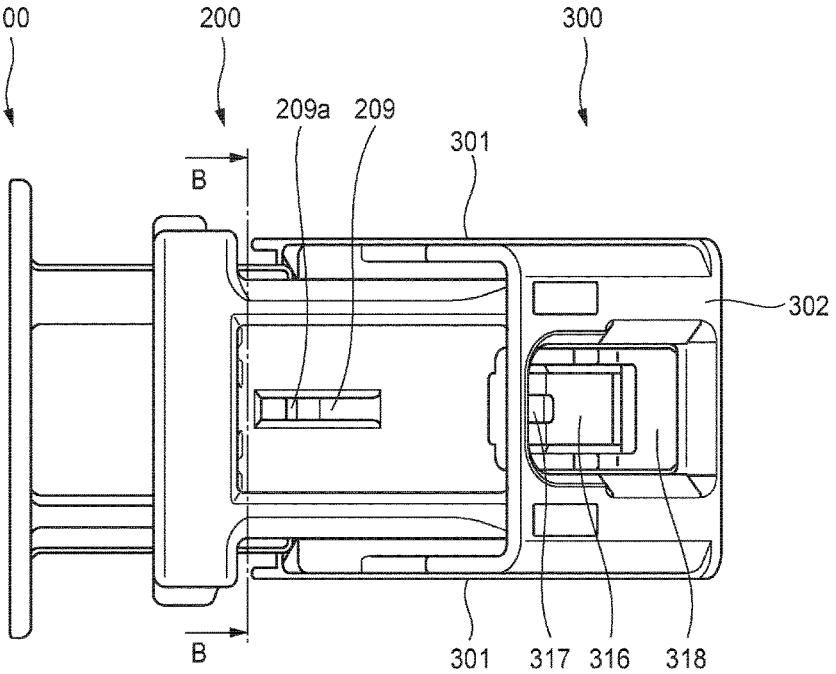
FIG. 11 is a side view of the male housing and the female housing in the state (in which the male housing and the female housing are being fitted to each other) shown in FIG. 9.
Figure 12:
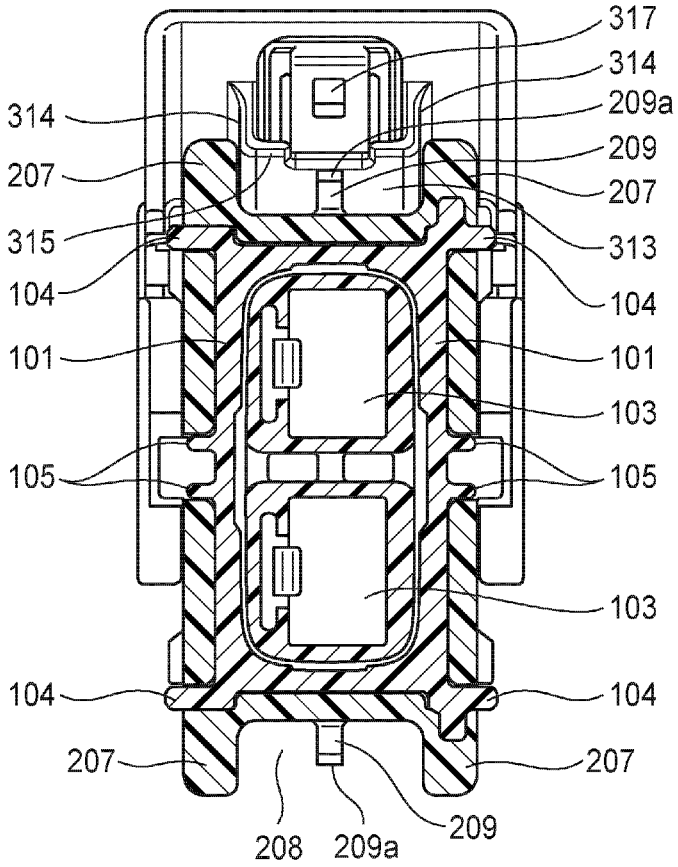
FIG. 12 is a sectional view taken on B-B in FIG. 11.

Staring in the fitting start state, the lever 300 is moved (rotated) from the temporary lock position toward the final lock position. Thus, as shown in FIG. 9, the side walls 310 of the grooves 307 push the bosses 106 toward the rear of the female housing 200 so that the bosses 106 (and hence the male housing 100) can be drawn toward the rear of the female housing 200 in accordance with the advance of the movement (rotation) of the lever 300. Further, as shown in FIG. 9 and FIGS. 11 and 12, the base portion 313 begins to be received in the recess portion 208 when the lever 300 is moving from the temporary lock position to the final lock position.

Figure 10:
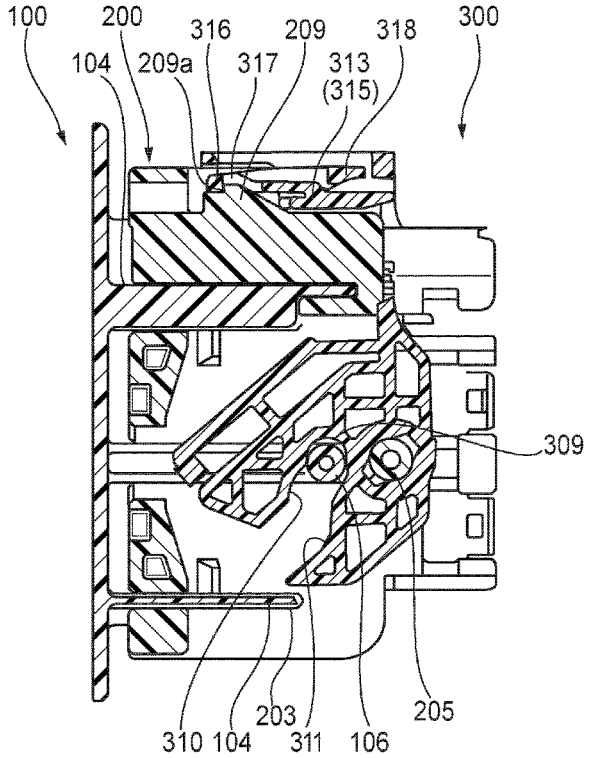
FIG. 10 is a sectional view taken on line A-A in FIG. 1, showing a state in which the male housing and the female housing have been completely fitted to each other.

Then, as shown in FIG. 10, when the lever 300 reaches the final lock position in the state where the base portion 313 has been received in the recess portion 208, the bosses 106 reach the deepest portions 309 (see FIGS. 3 and 4) of the grooves 307 to thereby bring the male housing 100 into the fitting completion state. At the same time, as described above, the lock hole 317 of the lock arm 316 is locked to the step portion 209*a* of the lock beak 209. Consequently, conductive connection between male terminals (not shown) and female terminals (not shown) provided in the male housing 100 and the female housing 200 respectively is completed while the lever 300 is retained in the final lock position.

Incidentally, in the above-described example, the locking of the pair of temporary lock arms 304 has been already released in the fitting start state (FIG. 8). However, the locking of the pair of temporary lock aims 304 may be still kept in the fitting start state. In this case, the male housing 100 is inserted up to the fitting start state in a state where the lever 300 has been retained in a position moving slightly rearward in the rotating direction from the temporary lock position. In the fitting start state, the tapered faces 306*a* (see FIGS. 3 and 4) of the pair of temporary lock arms 304 abut against the front end surfaces 104*a* (see FIG. 1) of the corresponding temporary lock releasing ribs 104 of the male housing 100, but are not pushed by the front end surfaces 104*a*. Accordingly, the pair of temporary lock arms 304 are not elastically deformed outward in the up/down direction.

Thus, the lever 300 cannot move forward in the rotating direction from the temporary lock position.

In this state, the lever 300 located in the position moving slightly rearward in the rotating direction from the temporary lock position is moved forward in the rotating direction (toward the temporary lock position). Thus, the side walls 310 of the grooves 307 push the bosses 106 toward the rear of the female housing 200 (to receive the bosses 106 in the grooves 307). Consequently, the tapered faces 306*a* of the pair of temporary lock arms 304 are pushed by the front end surfaces 104*a* of the corresponding temporary lock releasing ribs 104 so that the pair of temporary lock arms 304 can be elastically deformed outward in the up/down direction. As a result, the lever 300 can be brought into a state where the lever 300 can move from the temporary lock position toward the final lock position. Thus, the lever 300 can pass through the temporary lock position smoothly.

Incidentally, in order to release the fitting between the male housing 100 and the female housing 200 in the fitting completion state, the operating portion 320 of the releasing arm 318 is pushed to release the locking of the lock hole 317 to the step portion 209*a* as described above. In this state, the lever 300 is moved rearward in the rotating direction from the final lock position toward the temporary lock position. With the movement of the lever 300, the side walls 311 of the grooves 307 push the bosses 106 (and hence the male housing 100) toward the front of the female housing 200 (that is, push out the bosses 106 from the grooves 307). Thus, the male housing 100 is separated toward the front of the female housing 200 so that the fitting can be released.

According to the connector 10 according to the embodiment of the invention, the base portion 313 provided in the lever 300 is received to be held between the pair of ribs 207 (the recess portion 208) provided in the female housing 200. In the state where the base portion 313 has been received in the recess portion 208, the lock hole 317 of the lever 300 is locked to the step portion 209*a* of the lock beak 209. Thus, even when some misalignment occurs in the lever 300, the misalignment is corrected naturally in accordance with rotation of the lever 300, so that the lock hole 317 and the lock beak 209 can be positioned with each other, in comparison with the background-art connector. It is therefore possible to easily position the lever 300 and the female housing 200 with each other Further, when the lever 300 is moved from the temporary lock position toward the final lock position in a state where excessive misalignment occurs between the lever 300 and the female housing 200, the base portion 313 abuts against a top portion of one of the pair of ribs 207 on the way of the movement of the lever 300 so that the lever 300 cannot move more. On this occasion, the rotating angle of the lever 300 from the temporary lock position is so small from the temporary lock position that the base portion 313 cannot be perfectly received between the pair of ribs 207 (the recess portion 208). Therefore, it is possible to easily recognize an abnormal state in which the lever 300 does not reach the final lock position.

Further, the base portion 313 is not received in the recess portion 208 when the lever 300 is in the temporary lock position. The base portion 313 begins to be received in the reception portion 208 when the lever 300 is being rotated from the temporary lock position to the final lock position. To say other words, there is a distance between the recess portion 208 and the base portion 313 when the lever 300 is in the temporary lock position, and the recess portion 208 and the base portion 313 begin to abut against each other when the lever 300 is being rotated. Accordingly, the size of the base portion 311 and the size of the recess portion 208 (and hence the size of the connector 10) can be reduced as compared with a case where the base portion 313 is received at the time when the lever 300 is in the temporary lock position (for example, a case where the recess portion 208 extends to the lever 300 located in the temporary lock position or a case where the base portion 313 extends to the recess portion 208 from the lever 300 located in the temporary lock position).

Further, the cantilever-like arm structure (lock arm 316) is applied to a locking structure of the lever 300. In this case, the base structure supporting the arm structure (the fixed end of the cantilever) can be also used as a structure for positioning the lever 300 and the housing 200 with each other. Accordingly, the structure of the connector 10 can be simplified as compared with a case where the base structure and the positioning structure are provided separately from each other.

<Other Forms>

Incidentally, the invention is not limited to the above-described embodiment, but various modifications can be used within the scope of the invention. For example, changes, improvements, etc. can be made on the invention without limiting the invention to the above-described embodiment. In addition, materials, shapes, dimensions, numbers, arrangement places, etc. of respective constituent elements in the above-described embodiment are not limited. Any materials, any shapes, any dimensions, any numbers, any arrangement places, etc. may be used as long as the invention can be attained.

For example, although the lever 300 is attached to the female housing 200 in the above-described embodiment, the lever 300 may be attached to the male housing 100.

Further, according to the above-described embodiment, the base portion 313 is not received in the recess portion 208 when the lever 300 is in the temporary lock position, but the base portion 313 begins to be received when the lever 300 is being rotated from the temporary lock position to the final lock position. However, the base portion 313 may be received in the recess portion 208 when the lever 300 is in the temporary lock position.

Further, in the above-described embodiment, the base portion 313 of the lever 300 is constituted by the pair of side plate portions 314 forming a pair of wall surfaces, and the bottom plate portion 315 connecting protruding, ends of the pair of side plate portions 314 with each other, and the lock arm 316 of the lever 300 has a cantilever-like arm structure extending from the bottom plate portion 315. However, the lock arm 316 does not have to have the cantilever-like arm structure extending from the bottom plate portion 315.

In addition, in the above-described embodiment, the temporary lock releasing ribs 104 are provided on the opposite sides of the body peripheral wall portion 101 of the male housing 100 in the width direction, and the slits 203, the temporary lock protrusions 206, the pairs of ribs 207 (the recess portions 208) and the lock beaks 209 are provided on the opposite sides of the body peripheral wall portion 201 of the female housing 200 in the width direction. Thus, the connector 10 can operate even when the lever 300 is attached to either side of the female housing 200 in the width direction. However, when the lever 300 is attached to only one side of the female housing 200 in the width direction, a temporary lock releasing rib 104 may be provided only on one side of the body peripheral wall portion 101 of the male housing 100 in the width direction, and a slit 203, a temporary lock protrusion 206, a pair of ribs 207 (a recess portion 208) and a lock beak 209 may be provided on only one side of the body peripheral wall portion 201 of the female housing 200 in the width direction.

Here, the features of the above-described embodiment of the connector will be summarized and listed briefly in the following items <1> to <3>.

<1> A connector (10) including: a first housing (200); a second housing (100) fittable to the first housing; and a lever (300) attachable to the first housing to draw and fit the first housing (200) and the second housing (100) to each other by rotating around a rotating axis from a temporary lock position to a final lock position, wherein the lever (300) includes: a positioning portion (313) including a pair of wall surfaces (wall surfaces of 314) which extend toward the first housing (200) and which are spaced at a predetermined distance from each other in a first direction parallel to the rotating axis; and a lever side lock portion (316), and wherein the first housing (200) includes: a reception portion (208) which receives the positioning portion (313) so as to hold the pair of wall surfaces (wall surfaces of 314) in the first direction; and a housing-side lock portion (209) to which the lever-side lock portion (316) is locked in a state in which the positioning portion (313) has been received in the reception portion (208) and when the lever (300) is in the final lock position.

<2> The connector according to the item <1>, wherein the positioning portion (313) is not received in the reception portion (208) when the lever (300) is in the temporary lock position, and wherein the positioning portion (313) begins to be received in the reception portion (208) when the lever (300) is being rotated from the temporary lock position to the final lock position.

<3> The connector according to the item <1> or <2>, wherein the positioning portion (313) includes a base structure including: a pair of side plates (314) forming the pair of wall surfaces; and a bottom plate (315) connecting protruding ends of the pair of side plates (314) with each other, and wherein the lever-side lock portion (316) has a cantilever-like arm structure extending from the bottom plate (315).

What is claimed is:

1. A connector comprising:

a first housing;

a second housing fittable to the first housing; and a lever attachable to the first housing to draw and fit the first housing and the second housing to each other by rotating around a rotating axis from a temporary lock position to a final lock position, wherein the lever comprises:

a positioning portion comprising a pair of wall surfaces which extend toward the first housing and which are spaced at a predetermined distance from each other in a first direction parallel to the rotating axis; and a lever side lock portion, and wherein the first housing comprises:

a reception portion which receives the positioning portion so as to hold the pair of wall surfaces in the first direction; and a housing-side lock portion to which the lever-side lock portion is locked in a state in which the positioning portion has been received in the reception portion and when the lever is in the final lock position.

2. The connector according to claim 1, wherein the positioning portion is not received in the reception portion when the lever is in the temporary lock position, and wherein the positioning portion begins to be received in the reception portion when the lever is being rotated from the temporary lock position to the final lock position.

3. The connector according to claim 1, wherein the positioning portion comprises a base structure comprising: a pair of side plates forming the pair of wall surfaces; and a bottom plate connecting protruding ends of the pair of side plates with each other, and wherein the lever-side lock portion has a cantilever-like arm structure extending from the bottom plate.

* * * * *